United States Patent [19]

St. Denis

[11] Patent Number: 4,889,029

[45] Date of Patent: Dec. 26, 1989

[54] TUNING APPARATUS FOR STRINGED INSTRUMENTS

[75] Inventor: Carroll R. St. Denis, Winnipeg, Canada

[73] Assignee: Global Designs Inc., Winnipeg, Canada

[21] Appl. No.: 239,661

[22] Filed: Sep. 2, 1988

Related U.S. Application Data

[63] Continuation-in-part of Ser. No. 157,623, Feb. 19, 1988, abandoned.

[30] Foreign Application Priority Data

Feb. 19, 1987 [GB] United Kingdom ..... 8703865
Feb. 19, 1988 [CA] Canada ..... 559413

[51] Int. Cl.[4] ..... G10G 7/02
[52] U.S. Cl. ..... 84/454
[58] Field of Search ..... 84/454, DIG. 18

[56] References Cited

U.S. PATENT DOCUMENTS 3,813,983 6/1974 Paul ..... 84/454 X
4,088,052 5/1978 Hedrick ..... 84/454
4,365,537 12/1982 Pogoda ..... 84/454
4,523,506 6/1985 Hollimon ..... 84/454
4,589,324 5/1986 Aronstein ..... 84/454

*Primary Examiner*—W. B. Perkey
*Attorney, Agent, or Firm*—Stanley G. Ade; Adrian D. Battison; Murray E. Thrift

[57] ABSTRACT

A guitar tuner includes a manually graspable body with a head projecting outwardly from one end driven by a motor inside the body to rotate about an axis. The head includes a slot shaped opening for grasping the key of a conventional instrument such as a guitar. An input sensor in the body detects a tone from the string of the instrument and converts it to square wave of the detected frequency. This is compared by a microprocessor with the closest adjacent intended frequency of the instrument selected which acts to drive the motor to tighten or loosen the string as required to attain the required frequency. A digital display provides a readout of the number and letter of the string concerned. The user can select any one of a number of different states of the device for use with different instruments or different tunings. The user can also override the automatic string selection in cases where the string is a long way from its required frequency.

15 Claims, 5 Drawing Sheets

TUNING APPARATUS FOR STRINGED INSTRUMENTS

This application is a continuation-in-part of application Ser. No. 157,623 filed Feb. 19, 1988, now abandoned.

BACKGROUND OF THE INVENTION

This invention relates to a tuning apparatus for stringed instruments which is initially designed particularly for use with a guitar but which can be adapted for use with any other stringed instrument in which the string is tuned by turning a tuning peg.

Various proposals have been made previously for devices for use in tuning guitars. For example U.S. Pat. No. 4,375,180 (Scholz) discloses a device which is attached to a stringed musical instrument and which tightens or loosens each of the instruments strings by sensing the tension of the associated string and comparing the sensed tension with a reference tension corresponding to the desired tuning for the string. Such a device does however require an individual apparatus for each of the strings and has not achieved significant success in the market place. U.S. Pat. No. 4,018,124 (Rosado) discloses an arrangement in which diodes are illuminated when a particular string is tuned so that the user can adjust the tension of the string until the diode properly is illuminated. However this device again is unsatisfactory in that it is difficult for the inexperienced user to locate the required position and to ensure that the string is properly tuned.

Yet further arrangements are disclosed in German Patent Application No. 3509662 and U.K. Patent application No. 2,049,226, both of which discloses a device attached inside the guitar for operating on the string at the bridge end of the string to automatically obtain tuning of the string.

None of these devices has achieved significant commercial success and none is suitable for the average user of a guitar since it requires either skilled operation or highly complex and expensive devices provided wholly within the guitar.

SUMMARY OF THE INVENTION

It is one object of the present invention, therefore, to provide an improved guitar tuning device is which is convenient for the skilled guitar player or is even usable by a total beginner in view of the simplicity of operation.

According to a first aspect of the invention, therefore, there is provided a device for use in tuning a stringed instrument having a plurality of tuning pegs each of which can be rotated to alter the tension of a string associated therewith to vary the frequency of the note produced by the string when plucked, the device comprising a manually graspable body, a head member extending outwardly from the body and shaped to releasably engage one of the tuning pegs of the instrument, the body being separate from the instrument and movable such that the head member can be engaged with each of the pegs independently as required, a motor mounted in the body and arranged to drivingly rotate the head member to rotate said one peg, said motor being arranged to be rotated in both a clockwise and counterclockwise direction to tension and loosen the string as required, sensor means arranged to detect the note produced by the string when plucked and to calculate the fundamental frequency of the note, means storing a plurality of predetermined required frequencies, each associated with a respective one of the strings of the instrument, comparator means arranged to compare the fundamental frequency of the note of the string with said plurality of predetermined required frequencies and to select from said predetermined required frequencies that one of the frequencies which is closest to said fundamental frequency and means for driving rotation of the motor in a direction to alter the fundamental frequency of the note of the string to said one of the frequencies.

Preferably the head forms part of a manually operable tool which can be moved by the user so the head engages a chosen one of the tensioning pegs or keys of the guitar. Thus the user can operate each peg in turn while plucking the associated string.

The device preferably includes switch means in by which the user can override the automatic string selection and select the string intended for tuning, for use for example in tuning a freshly applied string which is thus a long way from proper tuning.

In one arrangement the manually graspable member including the head and motor also carries the sensor and supply batteries for the necessary power to the sensing and comparing system and also to the motor.

In an alternative arrangement a separate housing contains the sensor, battery for the sensor and the necessary switches together with the comparator circuitry and communicates with the manually operable device by a suitable plug in cable. A battery for the motor can be provided in the manually operable portion.

In a yet further arrangement the sensor, switch and necessary circuitry can be provided in the guitar itself with a plug in being provided for coupling the manually operable portion to the guitar so that it can be moved to each of the tuning pegs in turn.

Accordingto a second aspect of the invention there is provided a device for use in tuning a stringed instrument having a plurality of tuning pegs each of which can be rotated to alter the tension of a string associated therewith to vary the frequency of the note produced by the string when plucked, the device comprising a manually graspable body, a head member extending outwardly from the body and shaped to releasibly engage one of the tuning pegs of the instrument, the body being separate from the instrument and movable such that the head member can be engaged with each of the pegs independently as required, a motor mounted in the body and arranged to drivingly rotate the head member to rotate said one peg, said motor being arranged to be rotated in both a clockwise and counterclockwise direction to tension and loosen the string as required, sensor means arranged to detect the note produced by the string when plucked and to calculate the fundamental frequency of the note, means storing a plurality of a predetermined required frequencies, each associated with a respective one of the strings of the instrument, and comparator means arranged to compare the fundamental frequency of the note of the string with one of said predetermined required frequencies and to cause rotation of the motor in a direction to alter the fundamental frequency of the note of the string to said one of the frequencies said comparator means being arranged to detect the magnitude of the difference between said fundamental frequency and said one of said predetermined required frequencies and to cause rotation of said motor in pulses of different duration, the duration of each pulse being dependent upon the magnitude of the difference.

Although discussed above in conjunction with the guitar which is perhaps the most common currently used string instrument, minor modifications to the device mainly in relation to the software which generate the predetermined required tones can be made so that the device is suitable for other stringed instruments for example violins, banjos and the like. A yet further device may be manufactured which can be suitable for tuning a piano but of course this requires significantly more stored frequencies and generally the use of a manually operable device to select the different octaves of the piano switching in view of the very much increased number of strings.

In addition to the various configurations of the device, the control circuit can be manufactured using any suitable technology. For example devices can be manufactured using conventional electronics technology in which amplifiers, comparators and the like are assembled onto a circuit board by conventional techniques. Available tuning pods or the use of different resistors to generate predetermined tones can be used but tend to be less reliable. In addition micro processor control is much preferred as it has the possibility for widest adjustment or variations, possibly including adjustment from one instrument to another.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
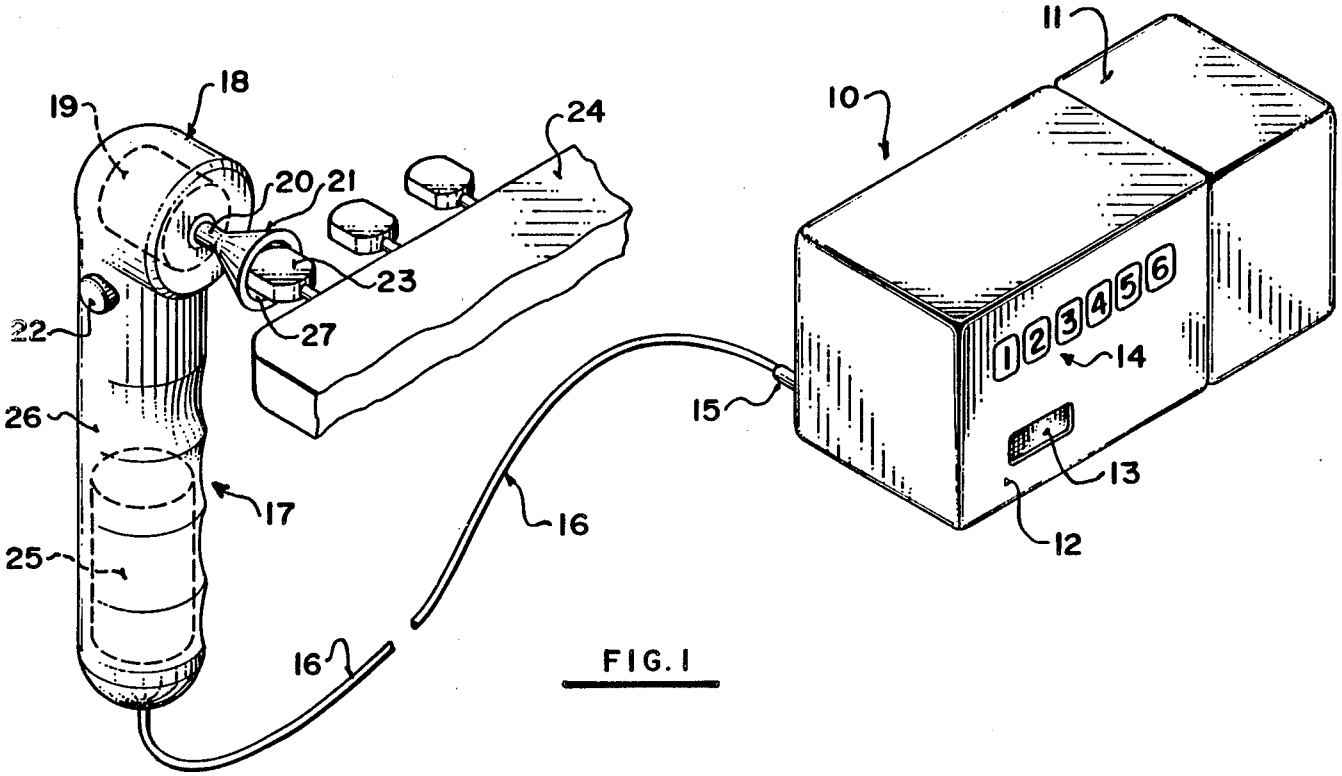
FIG. 1 is a schematic view showing the external appearance of one embodiment according to the invention

Turning firstly to FIG. 1, a housing 10 contains a battery section 11 providing power to a circuit (not shown) mounted within a section 12 of the housing. The section 12 carries on an outer face a microphone 13 for picking up sound from the guitar and a plurality of switches 14 which can be actuated to select one of the strings of the instrument for tuning. A coaxial socket 15 is provided on the casing for connecting to a wire 16 coupled to a hand graspable body 17. The body 17 has a head end 18 containing a motor 19 driving a shaft 20 carrying a drive head 21. The body carries a press button 22 which can be depressed by the thumb of the user while grasping the body portion and applying the head 21 to a key 23 of a guitar head 24. In some arrangements this can be omitted. A base end of the body contains a battery section 25.

The head 21 includes a slot 26 which can pass over the key and is elongated in one direction so as to receive the conventionally shaped key so that rotation of the head 21 acts to crank the key around its shaft to cause tightening of the string coupled thereto. Details of the key are not shown since these are well known to one skilled in the art and vary in dependence upon the type of instrument involved.

Figure 3:
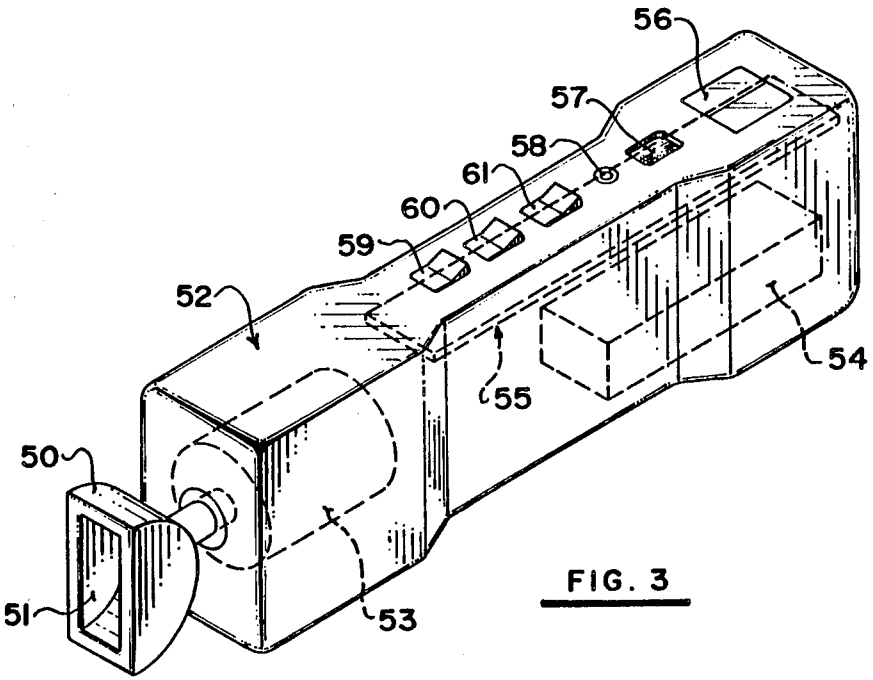
FIG. 3 is a circuit schematic isometric view showing the exterior appearance of an alternative arrangement according to the invention.

In the alternative arrangement shown in FIG. 3 the control circuitry is mounted within an area of the hand held tool and the microphone is mounted also on the hand held tool thus obviating the need for the separate housing.

In FIG. 3 the head is indicated at 50 and includes a slot shaped opening 51 which can engage around the conventional key of a musical instrument. The existance of play between the head and the key is not of importance since that play will initially be taken up by a rotation of the motor and the motor will continue to rotate until the key is rotated to the required position regardless of any lost motion between the head and the key. The head is mounted upon the body 52 which is suitably shaped for grasping by the hand of the user with the head projecting outwardly from one end of the body. Inside the body is mounted the motor 53, a battery section 54 and a circuit board 55. The battery section 54 can be accessed by an opening in the rear of the casing 52. The circuit board 55 carries the display 56 which is visible through an opening in the front of the casing. Also at the front of the casing is provided a microphone 57, a socket 58 for a jack plug from an electrical pick up, an on/off power switch 59 and the first and second switches indicated at 60 and 61 respectively.

In a yet further alternative arrangement (not shown) the control circuitry and microphone are positioned within the guitar body itself so as to again obviate the need for the housing 10. In this case a single multi-position switch may be provided on the guitar to adjust between the different strings. The socket 15 can also be provided on the body of the guitar for connecting to the wire 16 of the tool 17. Battery power to the control circuit can be provided from the battery section 25 of the tool with a separate battery provided for the motor 19. A DC adaptor can be used to supply power in place of the battery.

Figure 2:
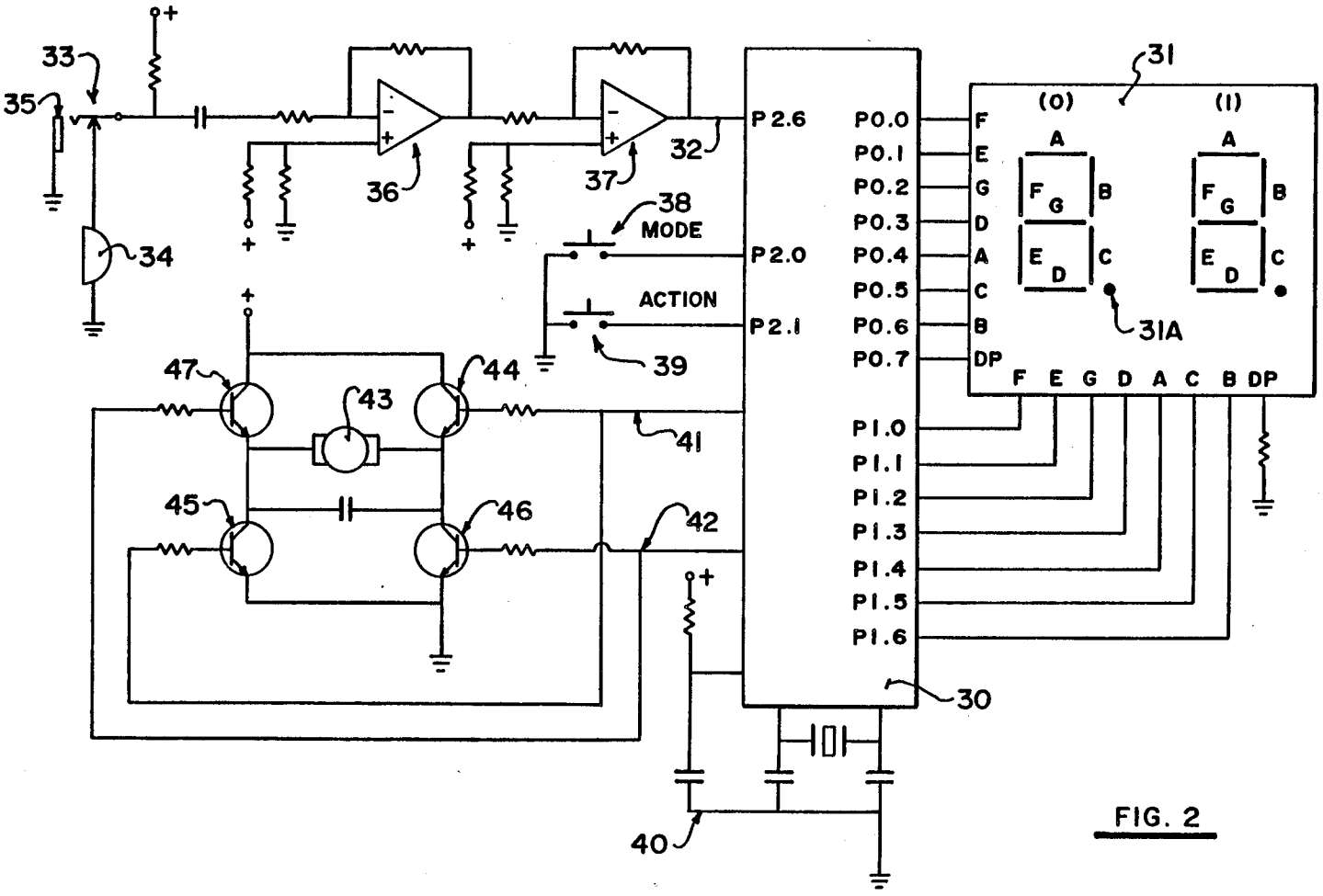
FIG. 2 is a schematic diagram of the circuit one of embodiment of the invention device.

Turning now to FIG. 2 there is shown a block diagram of the circuit of the device. The circuit for the device includes a microprocessor generally indicated at 30 which provides a plurality of outputs to a two digit digital display 31.

Inputs to the microprocessor are provided by a signal line indicated at 32 which receives the signal or note to be compared from an input 33 comprising either a microphone 34 or a connector 35 for direct connection to the output of an electric pick up of the instrument. A filtering circuit is used to remove harmonies and to tend to isolate the fundamental frequency of the wave. The detected signal generally in the form of a periodic wave of the frequency dependant upon the tension and physical properties of the string is amplified in a first amplifier indicated at 36. A second amplifier indicated at 37 acts to over-amplify the input wave thus approximating a rectangular wave having a frequency equal to that of the input wave. The amplification is such that the leading and trailing edges of the rectangular wave are effectively directly vertical which can thus be detected by the microprocessor 30.

A further input to the microprocessor is provided by a first switch indicated at 38 which can be manually actuated in the form of a simple press button switch on the outside of the casing. A second switch of similar construction is indicated at 39. The conventional circuit indicated generally at 40 which provides the required voltages and timing signals for controlling the microprocessor operation.

Outputs from the microprocessor are provided on lines 41 and 42 arranged to drive a motor 43 in clockwise and anticlockwise directions respectively. Thus the line 41 provides base current for a transistor 44 and for a transistor 45 thus connecting voltage of one polarity across the motor 43. Similarly the line 42 provides base current for a transistor 46 and for a transistor 47 connecting voltage of the opposite polarity across the motor 43.

The circuit and particularly the microprocessor are arranged and programmed to carry out the following steps:

1. The microprocessor detects on line 32 the leading edge or trailing edge of the rectangular wave and measures the interval between successive edges in dependence upon the pulses from the crystal in the circuit 40. The time period can be used simply to calculate a frequency for the rectangular wave and thus the input wave of the note generated by the string.
2. In order to improve the accuracy of the calculated frequency, an average can be taken over a plurality of waves for example five or ten depending upon a required accuracy. The average will also accommodate the gradually changing note as it is altered by the rotation of the motor 43 driving the key of the associated string.
3. Noise detected at the input 33 will distort the period of the rectangular wave system by adding further wave edges in dependence upon the structure of the noise. The microprocessor removes the effect of the noise by measuring the time differences as explained above for a plurality of square waves received and then discounting or discarding those measured periods which differ from a mean period by an amount greater than a predetermined amount, of course making the assumption that those differences are caused by the presence of noise or the unrequired square waves.
4. When the circuit is placed into a particular state for a required instrument as explained hereinafter, on detection of a tone and a calculation of the frequency of that tone, the microprocessor acts to compare that frequency with a set of stored frequencies which are retained in memory in the microprocessor then chooses that one of the stored frequencies which is closest to the detected frequency and acts to adjust the string to attain the selected one of the stored frequencies.
5. Firstly therefore the microprocessor indicates on the digital display 31 the chosen frequency. This is indicated by a number indicated in a lefthand one of the display digits corresponding to the string concerned. Thus in a six-string guitar for example the uppermost or base string can be designated 1 and the remaining strings designated 2 to 6 in turn. In addition in the righthand digit, the microprocessor can display the corresponding note in letter form to which that string is intended to be tuned. For example in the conventional guitar the base string is tuned to note E in octave 1 which has an absolute frequency of 82.41 hz. The indication therefore on the digital display provides for the experienced user an indication of the letter of the string concerned and for the inexperienced user an indication of the number of the string concerned.
6. At the same time as providing the display, the microprocessor also generates a signal on line 41 or line 42 depending upon whether the calculated frequency is above or below the required stored frequency. The motor will continue to be driven while sampling of the tone continues, that sampling being repeated every five to ten cycles depending upon requirements. On the detected frequency reaching equality with the chosen frequency, the output to the line 41 or 42 is halted and the motor thus stops. The microprocessor simultaneously withhalting the output on the line 41 or 42 also supplies an output to the digital display 31 to illuminate the period mark indicated at 31A.
7. On detection of a subsequent tone, the microprocessor repeats the above steps to tune the string next selected and plucked by the user, again selecting the frequency closest to the detected frequency.
8. If, observing the indicated string which is being tuned as shown in the digital display as explained previously, should the user find that the indicated string is not the string which is being tuned that is the string being tuned is a long way from its required frequency, the user can override the selection of the closest frequency by actuation of the switch 39. Thus repeated depression of the switch 39 will cycle the selection of the string concerned through the number of strings of the instrument. Thus for example on a six string guitar, each depression of the switch 39 will move the selected string onto the next string numbered 1 to 6 returning after 6 of course back to the number 1 string. In this way the user can if he knows that the string is a long way from its required frequency, pre-select the string frequency to be used by the microprocessor. In this way the device can be used for an initial winding of the string from a very loose condition up to the required tensioned condition to provide the right frequency.

9 The switch 38 can be actuated by the user to select one of a number of different states for the microprocessor. Each of these states can be used to retain the required frequencies for a different instrument or for a different tuning of that instrument. The different states can be numbered from 00 to 99 thus enabling the storage in the device of the required conditions for various different instruments tuned in different ways. Thus the device can be used for many different instruments including sixstring guitars, twelve-string guitars, fourstring banjoes, five-string banjoes, mandolins and many others. If required different turnings for the above instruments can be recorded under different numbered states.

10. As is accepted in conventional musical practice, the note A in the third octave has a frequency of 440.00 hz. Other tunings are however possible and the frequencies of all of the notes are offset in accordance with the offsetting of the basic note A. In some cases a tuning of 438 hz can be used in other of the cases a tuning of 445 hz is used. This requirement can be entered into the microprocessor either by recording the necessary frequencies for each instrument under the different turnings as different states or by providing one of the states which enables a selection of the required basic frequency.

11. In one arrangement the microprocessor stores all of the above frequencies in memory so that as the required mode or state is chosen the associated frequencies are brought forward. In an alternative arrangement the frequencies can be calculated from a base or a plurality of base frequencies which are stored in memory. The latter arrangement reduces the amount of memory which is necessary and therefore can be advantageous in certain circumstances.

Figure 4:
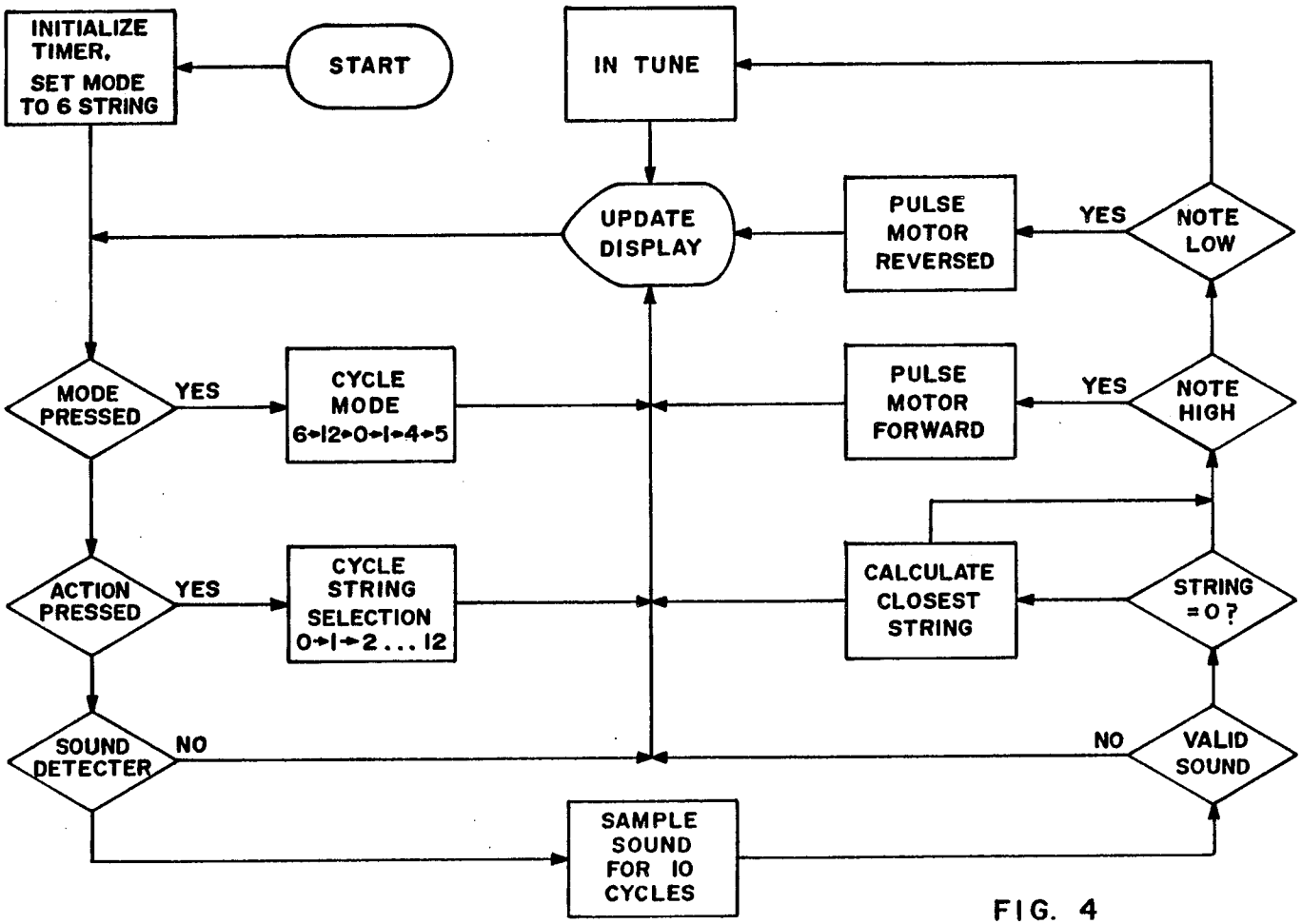
FIG. 4 is a schematic flow chart for the program of the microprocessor unit.

The above conditions are shown in flow sheet form in FIG. 4.

The device of FIG. 1 can also be used merely to act on a string winder in which the motor and power supply are separate from the microprocessor and can be used separately under control merely of the user's finger on a suitable press switch.

Figure 5:
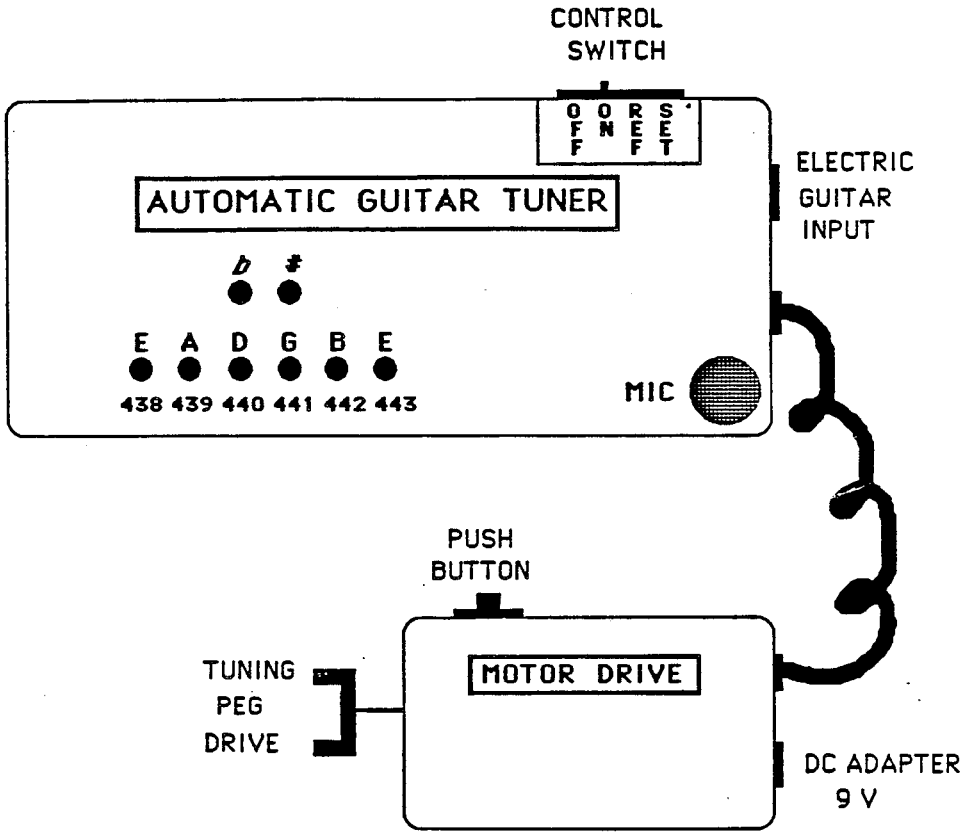
FIG. 5 is a schematic view showing the exterior appearance of a yet further alternative arrangement.

Turning now the alternative arrangement shown in FIG. 5. An electret microphone provides approximately 5 mV of signal which is preamplified to match the typical electric guitar levels of 20 to 100 mV. The gain is rolled off at low frequencies and above 2 kHz. The lower acoustic output of the G, B, and E strings requires about a 12 to 6 inch guitar-to-microphone separation.

Two active filters are used to amplify the signal and minimize harmonic content and high frequency noise. A 4 pole narrow band filter at 140 Hz is used to process the E, A and D strings. It consists of two cascaded 2-pole sections. A 3-pole filter at 305 Hz is used on the G, B, and E strings. The corner frequencies have been carefully chosen to optimize fundamental signal strength versus harmonic content.

As an alternative filter arrangement, a fourth order Butterworth filter chip, which is commercially available can be used.

The outputs from the two filters is selected by simple diode switches controlled by the microprocessor. The selected signal is capacitively coupled to a comparator with hysteresis and then input to the microprocessors interrupt line. The signal at this point has been converted by a Schmidt trigger to a 5 volt rectangular waveform with transitions roughly at the plucked note's signal zero crossings.

The microprocessor utilizes these transitions to determine the note period, using an oscillator to generate a number of pulses proportioned to the note period.

An Intel 8031 microprocessor is used with external PROM in the standard configuration. Two pins have been reserved to allow programming for different tuner models (eg. 6 string, bass, mandolin, etc.) or as desired. The power/mode switch is sensed at two pins to initiate the reference function as described hereinafter.

Eight LED's are provided to indicate the string being tuned (E, A,D,G,B,E) and the status (sharp, flat). To economize on parts count, they are activated using only 5 lines of an 74HC244 driver. The remaining 3 lines are used to drive a speaker (1 line) and the motor (2 lines).

The tuner is powered by a 9V battery. It is reversal protected by a diode and then regulated to provide 5 Vdc for use by the analog and digital electronics. Three diodes are used to generate a reference voltage (Vbias) for the op amps. The design also allows for the 9 volts to be supplied via the connecting cable from the motor drive unit.

The motor drive receives forward and reverse control signals from the tuner and drives the motor accordingly. Power is supplied to a H-bridge from an internal 9 v battery or externally from a dc adapter. The adapter should be carefully selected to avoid the possibility of 60 Hz interference being conducted to the filter circuits. The motor drive current draw is of the order of 600 mA, although the very intermittent duty cycle can result in a 1 to 2 week battery life under lab test use. A conventional 4 conductor telephone cable is used to link the motor drive to the guitar tuner unit.

In operation of the device shown in FIG. 5, the device can initially merely be set to the on position by actuation of the switch at which time the tuner is automatically initialized at the "A" reference of 440 Hz. In order to change the reference from 440 Hz to the other references available, the control switch is moved to SET at which time the LED's light in sequence. When the LED corresponding to the new desired reference is lit, the control switch is moved to the REF at which time the LED associated with the selected reference will be illuminated. The switch is then moved back to the ON position and tuning can proceed as follows. Of course when it is required to use the A reference at 440 Hz, no action is required to alter the reference selected.

With the device in the ON position, the user plucks the string preferably engaging the string at or around the 12th fret so that a note is generated by the string which can be received in the unit either by the microphone or by a direct plug in connection for an electric guitar. The unit thus acts to monitor this input note and attempts to discriminate a valid note from random background noise. The filter described above acts to reduce the harmonic content of the signal leaving effectively only the fundamental note of interest which is converted to a rectangular wave by the Schmidt trigger and the filtered note analyzed by the microprocessor.

The microprocessor acts to compare the note analyzed with the stored reference frequencies for the individual strings and selects that reference frequencies which is closest to the frequency of the analyzed note.

When a string has been thus identified, the LED associated with that string is illuminated and the unit commences the tuning operation. The tuning is divided into a first rough tune mode followed by a fine tune mode.

In the rough tune mode, the microprocessor acts to emit pulses to the motor drive system in a clockwise or counterclockwise direction as appropriate and at the same time acts to illuminate the LED associated with the sharp/flat display. The rough tune mode continues until the measured period variance is less than 128 microseconds. Before any pulse is generated, however, the microprocessor samples a plurality of wave lengths and insures that a number of such wave lengths falling within a predetermined band are properly sampled and averaged before a pulse is generated. This ensures that the motor is not driven by the detection of extraneous noise.

On completion of the rough tune mode, the unit transfers to the fine tune mode. In this mode the unit averages a number of period samples to eliminate noise and deter effects and to arrive at an accurate period measurement. The pulses generated by the microprocessor are calculated to have a period proportional to the difference between the measured frequency and the target frequency so that the period of the pulses decreases as the measured frequency approaches the target frequency. The microprocessor thus repeatedly samples the frequency of the note produced and after each sampling drives the motor through one pulse of a length determined by the sampling. The motor and display is driven accordingly until the period error is within the desired tolerance. As the string becomes closer to the tune the motor pulses become narrower since the motor is pulsed for a number of milliseconds proportional to the measured period error after each averaging period.

In many cases it is possible for the pulse of the motor generated to cause an overshooting of the target frequency in which case the motor is then pulsed in the reverse direction so that the string is gradually brought by pulses of reduced length up to the required target frequency.

In cases where the operator knows that the string concerned is very far from its required tuning or target frequency, the operator can select a target frequency by moving the switch to the SET position at which the LED's will light in sequence. When the LED corresponding to the required string or target frequency is illuminated the control switch is moved to the ON position which sets the microprocessor on that target frequency regardless of the difference between the detected frequency and the target frequency. This can be used in cases where a new string is applied and is required to be wound up to a required tension.

Since various modifications can be made in my invention as hereinabove described, and many apparently widely different embodiments of same made within the spirit ad scope of the claims without departing from such spirit and scope, it is intended that all matter contained in the accompanying specification shall be interpreted as illustrative only and not in a limiting sense.

I claim:

1. A device for use in tuning a stringed instrument having a plurality of tuning pegs each of which can be rotated to alter the tension of a string associated therewith to vary the frequency of the note produced by the string when plucked, the device comprising a manually graspable body, a head member extending outwardly from the body and shaped to releasably engage one of the tuning pegs of the instrument, the body being separate from the instrument and movable such that the head member can be engaged with each of the pegs independently as required, a motor mounted in the body and arranged to drivingly rotate the head member to rotate said one peg, said motor being arranged to be rotated in both a clockwise and counterclockwise direction to tension and loosen the string as required, sensor means arranged to detect the note produced by the string when plucked and to calculate the fundamental frequency of the note, means storing a plurality of predetermined required frequencies, each associated with a respective one of the strings of the instrument, comparator means arranged to compare the fundamental frequency of the note of the string with said plurality of predetermined required frequencies and to select from said predetermined required frequencies that one of the frequencies which is closest to said fundamental frequency and means for driving rotation of the motor in a direction to alter the fundamental frequency of the note of the string to said one of the frequencies.

2. The invention according to claim 1 including visual indicator means for indicating each of said plurality of predetermined required frequencies, said comparator means being arranged to cause said indicator means to indicate the predetermined frequency which has been selected.

3. The invention according to claim 1 wherein visual indicator means is arranged to provide an indication when the note of the string is equal to the predetermined frequency.

4. The invention according to claim 1 wherein said storing means is arranged to provide for each string a set of predetermined frequencies, with respective ones of the sets of all the strings being associated with one of a plurality of reference frequencies, and wherein there is provided manually actuable switch means for selecting one of said reference frequencies.

5. The invention according to claim 1 including manually actuable switch means arranged to over-ride said comparator means and select a chosen one of said stored frequencies.

6. The invention according to claim 1 wherein the sensor means includes means arranged to generate from the tone of the string a rectangular wave and wherein the comparator means includes means for detecting edges of said rectangular wave and for calculating the period therebetween.

7. The invention according to claim 1 wherein said head member includes a slot shaped opening therein arranged to loosely fit over a conventional key of a stringed instrument.

8. A device for use in tuning a stringed instrument having a plurality of tuning pegs each of which can be rotated to alter the tension of a string associated therewith to vary the frequency of the note produced by the string when plucked, the device comprising a manually graspable body, a head member extending outwardly from the body and shaped to releasably engage one of the tuning pegs of the instrument, the body being separate from the instrument and movable such that the head member can be engaged with each of the pegs independently as required, a motor mounted in the body and arranged to drivingly rotate the head member to rotate said one peg, said motor being arranged to be rotated in both a clockwise and counterclockwise direction to tension and loosen the string as required, sensor means arranged to detect the note produced by the string when plucked and to calculate the fundamental frequency of the note, means storing a plurality of a predetermined required frequencies, each associated with a respective one of the strings of the instrument, and comparator means arranged to compare the fundamental frequency of the note of the string with one of said predetermined required frequencies and to cause rotation of the motor in a direction to alter the fundamental frequency of the note of the string to said one of the frequencies said comparator means being arranged to detect the magnitude of the difference between said fundamental frequency and said one of said predetermined required frequencies and to cause rotation of said motor in pulses of different duration, the duration of each pulse being dependent upon the magnitude of the difference.

9. The invention according to claim 8 including visual indicator means for indicating each of said plurality of predetermined required frequencies, said comparator means being arranged to cause said indicator means to indicate the predetermined frequency which has been selected.

10. The invention according to claim 8 wherein visual indicator means is arranged to provide an indication when the note of the string is equal to the predetermined frequency.

11. The invention according to claim 8 wherein said storing means is arranged to provide for each string a set of predetermined frequencies, with respective ones of the sets of all the strings being associated with one of a plurality of reference frequencies, and wherein there is provided manually actuable switch means for selecting one of said reference frequencies.

12. The invention according to claim 8 wherein said comparator means is arranged to compare the fundamental frequency of the note of the string with each of said predetermined required frequencies and to select from said predetermined required frequencies that one of the frequencies which is closest to said fundamental frequency and wherein there is provided manually actuable switch means arranged to over-ride said comparator means and select a chosen one of said stored frequencies.

13. The invention according to claim 1 wherein the sensor means includes means arranged to generate from the fundamental frequency of the string a rectangular wave and wherein the comparator means includes means for detecting edges of said rectangular wave and for generating a signal representative of the period therebetween.

14. The invention according to claim 1 wherein said head member includes a slot shaped opening therein arranged to loosely fit over a conventional key of a stringed instrument.

15. The invention according to claim 8 wherein said comparator means is arranged upon sensing a note to detect and to calculate the fundamental frequency of the note over a plurality of cycles of the note and to cause rotation of said motor only after said plurality of cycles.

* * * * *